US007053845B1

(12) United States Patent
Holloway et al.

(10) Patent No.: US 7,053,845 B1
(45) Date of Patent: May 30, 2006

(54) COMBINATION AIRCRAFT ANTENNA ASSEMBLIES

(75) Inventors: David J. Holloway, Whittier, CA (US); Donald E. Jeckell, Glendora, CA (US); Rene F. Gomez, Cerritos, CA (US)

(73) Assignee: Comant Industries, Inc., Fullerton, CA (US)

( * ) Notice: Subject to any disclaimer, the term of this patent is extended or adjusted under 35 U.S.C. 154(b) by 0 days.

(21) Appl. No.: 10/755,033

(22) Filed: Jan. 9, 2004

Related U.S. Application Data

(60) Provisional application No. 60/439,252, filed on Jan. 10, 2003, provisional application No. 60/439,381, filed on Jan. 10, 2003.

(51) Int. Cl.
*H01Q 21/00* (2006.01)

(52) U.S. Cl. ..... 343/725; 343/708; 343/722

(58) Field of Classification Search ..... 343/700 MS, 343/705, 708, 722, 725
See application file for complete search history.

(56) References Cited

U.S. PATENT DOCUMENTS 5,610,620 A * 3/1997 Stites et al. ..... 343/725
6,147,576 A * 11/2000 Arevalo ..... 333/204

* cited by examiner

*Primary Examiner*—Shih-Chao Chen
(74) *Attorney, Agent, or Firm*—Leo Stanger

(57) ABSTRACT

An aircraft antenna includes an aerodynamic housing structured for attachment to an outer surface of an aircraft, and the housing contains an electromagnetic radiator and tuned over a first band of frequencies potentially to produce secondary radiations in at least a second band of frequencies, and a suppression filter effective at the frequencies of the secondary radiations.

20 Claims, 9 Drawing Sheets

COMBINATION AIRCRAFT ANTENNA ASSEMBLIES

RELATED APPLICATIONS

This invention relates to U.S. application Ser. No. 60/439,252 filed Jan. 10, 2003 and entitled "Combination Antennas", and to U.S. application Ser. No. 60/439,381 filed Jan. 10, 2003 and entitled "Combination Antennas". Applicant claims the benefit of these applications under 35 USC 120.

FIELD OF THE INVENTION

This invention relates to aircraft antennas, and particularly to aircraft antennas that limit drag on an aircraft while avoiding interference with each other.

BACKGROUND OF THE INVENTION

Aircraft carry a number antennas for navigational, communication, and other purposes. However, the limited space on the outer surface of an aircraft may require placement of the multiple antennas in close enough proximity to each other to create radio interference between them. In particular, harmonics generated by one antenna may interfere with coincident frequencies in the frequency bands of other antennas. Moreover the various antennas project from the outer surface of the aircraft and introduce drag that interferes with the aerodynamic performance of an aircraft.

SUMMARY OF THE EMBODIMENTS OF THE INVENTION

According to an embodiment of the invention an aircraft antenna includes an integrated low profile shielded harmonic suppression filter that permits close placement of antennas.

According to another embodiment of the invention, two antenna radiators are combined in a single aerodynamic housing to form a single combination antenna and one radiator includes an integrated harmonic suppression filter.

These and other features of the invention are pointed out in the claims. Other aspects of the invention will become evident from the following detailed description when read in light of the accompanying drawings.

DETAILED DESCRIPTION OF THE PREFERRED EMBODIMENTS

Figure 1:
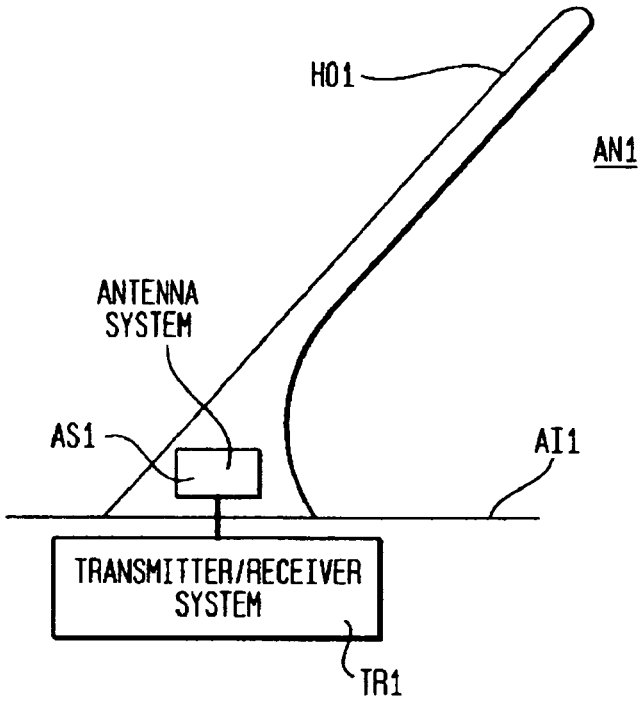
FIG. 1 is a schematic illustration including a side view of an antenna mounted on an airframe and embodying features of the invention.
Figure 2:
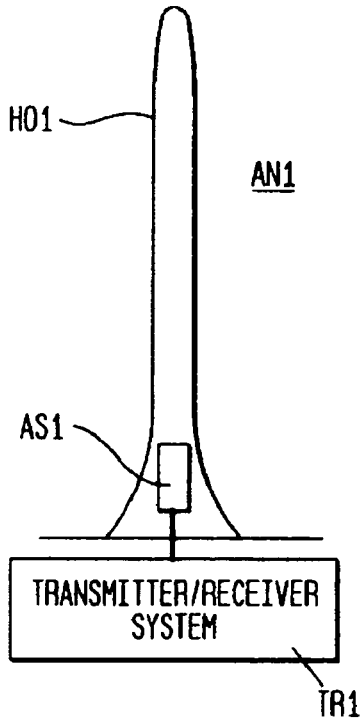
FIG. 2 is a schematic diagram including a front view of the antenna in FIG. 1 mounted on an airframe and embodying features of the invention.

In FIGS. 1 and 2, an antenna AN1 embodying the invention includes a flat, low drag, high speed, antenna housing HO1 that envelops an antenna system AS1, and rests securely on the outer and upper surface of an aircraft AI1 such as on a wing or fuselage. Suitable means secure the housing HO1 to the outer surface of the skin of the aircraft AI1. A transmitter/receiver system TR1 that may include one or more transmitters or receivers drives, and receives signals from the antenna system AS1.

Figure 3:
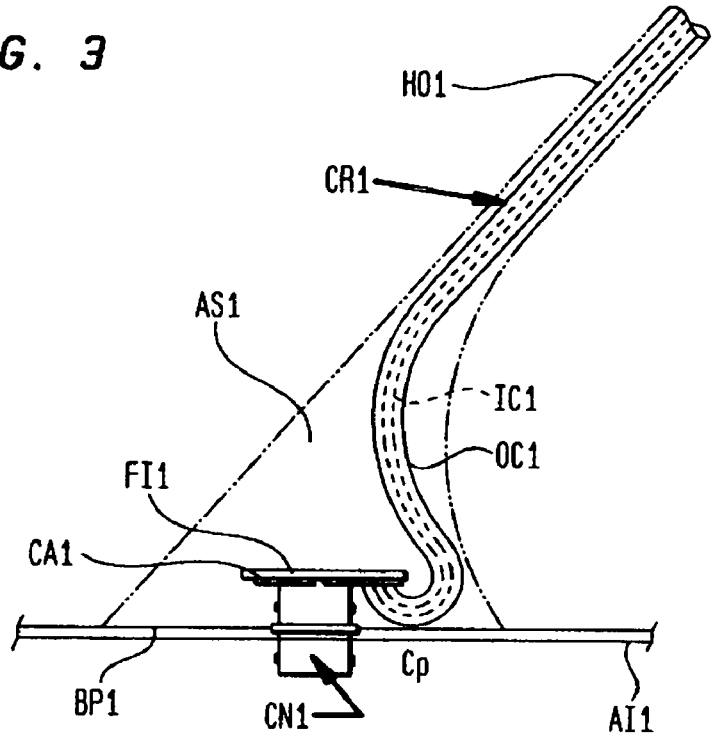
FIG. 3 shows details of the antenna in FIGS. 1 and 2 mounted on an airframe and embodying features of the invention.
Figure 3A:
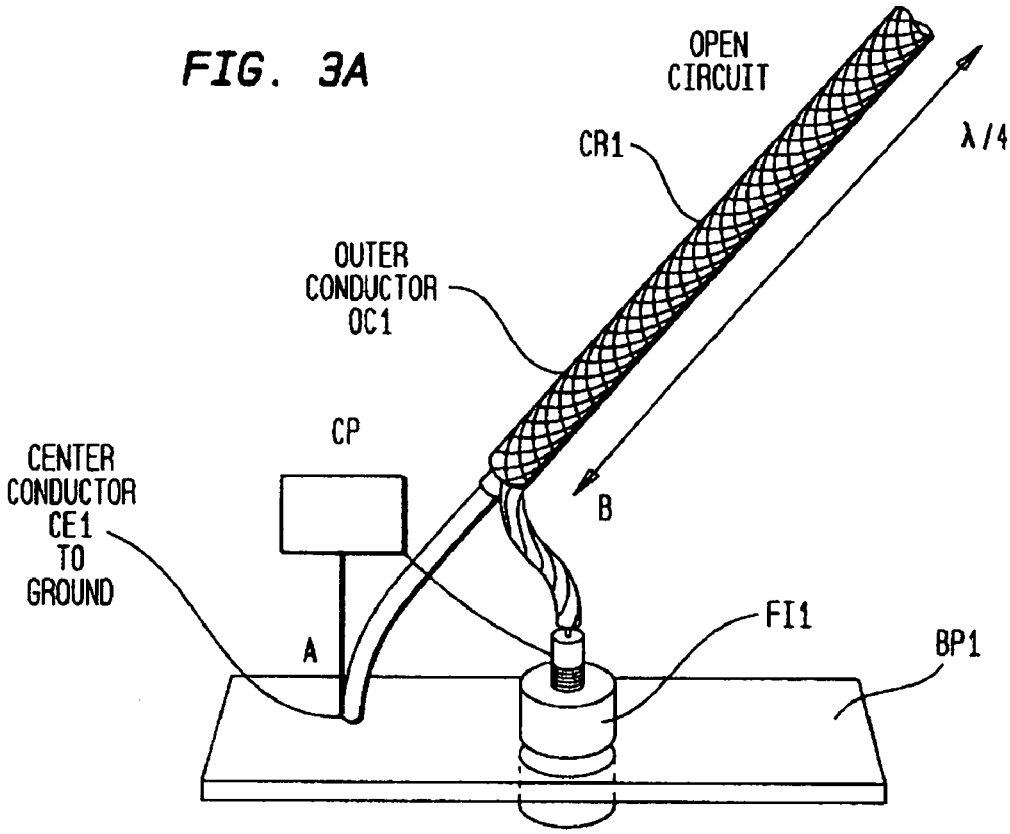
FIG. 3A is a schematic representation of an embodiment of the antenna in FIGS. 1, 2, and 3 mounted on an airframe.
Figure 4:
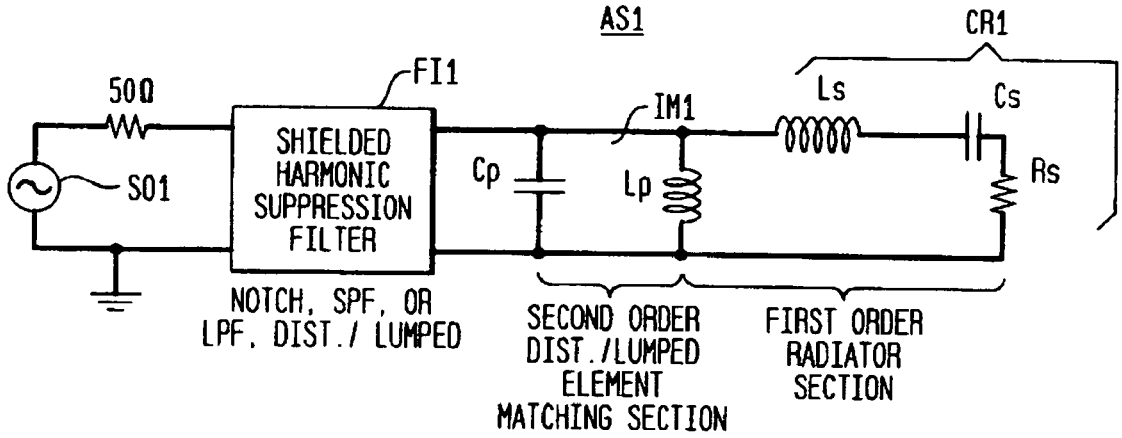
FIG. 4 is a schematic equivalent circuit of an embodiment of the antenna of FIGS. 1, 2, 3, and 3A.

FIGS. 3, 3A, and 4 illustrate an embodiment of details involving the antenna system AS1 tuned to a VHF band. Here, a base plate BP1 in the housing HO1 rests on the surface of the aircraft AI1. A connector CN1 secured on the base plate BP1 projects from the housing HO1 through the base plate and the skin of the aircraft AI1. The connector CN1 supports a harmonic suppression filter FI1, within a grounded radiation-shielding can CA1, and in the housing HO1. The connector CN1 connects the system AS1 to the aforementioned transmitter/receiver system TR1.

In the system AS1, cable radiator CR1 extends from the filter FI1 into the upper end of the housing HO1 and terminates in an open end. The cable radiator CR1 contains an inner conductor IC1 and a sleeve or shield or outer conductor OC1. At the lower end of the cable radiator CR1 the inner conductor IC1 connects to ground at the grounded shielding can CA1 and the outer sleeve or outer conductor OC1 of the cable radiator CR1 connects to the harmonic suppression filter FI1. A capacitor Cp rests under the shielding can CA1 and is connected across the filter FI1 from the outer conductor OC1 to ground. The antenna system AS1 of FIG. 3, when incorporated in the housing HO1 of FIGS. 1 and 2 forms a monopole antenna.

The shielded harmonic suppression filter FI1 is, according to various embodiments, a multiple section notch, low pass, or band pass filter built with either distributed or lumped element components.

FIG. 4 shows the equivalent circuit for the monopole antenna including the integrated harmonic suppression filter FI1. Here, the circuit also includes the monopole antenna radiator element or cable radiator CR1 appearing as a series RLC circuit with an inductance Ls, a capacitance Cs and a resistance Rs tuned to the center frequency, for example 127.5 MHz, of a VHF band. An inductance Lp represents the "apparent" or "internal" inductance of the open-ended cable radiator CR1 as seen from the radiator's lower end across the inner conductor IC1 and the outer conductor OC1. The capacitor Cp connects across the inductance Lp.

The capacitor Cp has a value to tune the parallel circuit of capacitor and inductance Lp, to the same center frequency as the cable radiator CR1 represented by the inductance Ls and capacitance Cs, for example 127.5 MHz. This produces the double-dip VSWR appearing in FIG. 4A across a band from 118 MHz to 137 MHz. The capacitor Cp and inductance Lp form an impedance matching network IM1.

According to different embodiments, the monopole antenna AN1 of FIGS. 1 to 4 and 3A is tuned over various VHF and UHF frequencies (VHF Comm. 118–137 MHz, Orbcomm 137–150 MHz, Wideband VHF/Orbcomm 118–150 MHz, etc.). The integration of a low-profile shielded harmonic suppression filter with the monopole antenna's VHF/UHF impedance matching network suppresses any harmonic interference such as 12th or 13th harmonics, generated by the transmitter in the transmitter/receiver TR1 that may be coincident with the frequency band(s) of other antennas tuned to any of GPS (1,575.42 MHz), WSI (1,544.5 MHz), XM Satellite and/or Sirius Satellite (2,332.0–2,345 MHz), Globalstar (2,483.5–2,500 MHz and 1,610.0–1,626.5 MHz), Iriduim (1,616–1,626.5 MHz), Satcom (1,530–1,559 and 1,626.5–1,660.5 MHz), etc. The resultant reduction in Radio Frequency Interference (RFI) from the monopole antenna allows for higher frequency antennas to be placed close to the monopole antenna without the risk of degrading their electrical performance.

Figure 5:
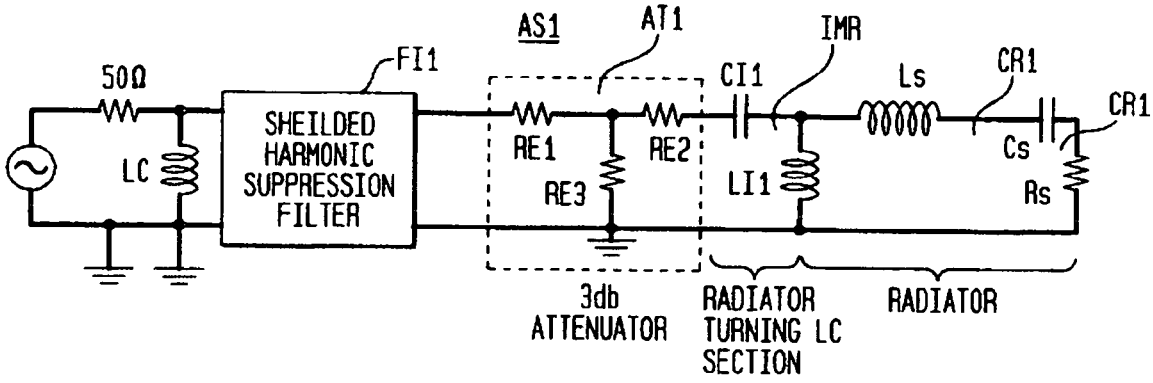
FIG. 5 is a schematic equivalent circuit of another embodiment of the antenna of FIGS. 1, 2, 3, and 3A.

Another embodiment of the antenna AN1 appears in FIG. 5. Here the antenna system AS1 in the housing HO1 also includes the monopole antenna radiator element or cable radiator CR1 also shown as the RLC circuit with inductance Ls, a capacitor Cs and a resistor Rs. It also includes an impedance matching network MI2, a wide band resistive T-configuration attenuator AT1 composed of three resistors RE1, RE2, and RE3, and the shielded multiple section notch, low pass, or band pass filter IF built with either distributed or lumped element components. In the impedance matching network IM2, a capacitor CI1 (33 pf in one embodiment for example) is placed in series with the attenuator AT1 and a lumped or distributed parallel LI1 inductor (530 nH in one embodiment for example) across the radiator CR1. The This structure enables the antenna AN1 to tune over wider frequency bandwidths for either transmit or receive applications over frequency bands in the VHF/UHF frequency spectrum (Wideband VHF/Orbcomm 118–150 MHz, etc.). A (120 nH in one embodiment for example) lumped element or distributed inductor Lc in the housing HO1 and across the input of (in parallel with) the filter FI1 input compensates for parasitic capacitance (approximately 10 pF) of the filter FI1 at VHF frequencies and broaden out the VSWR across the desired wideband VHF frequency band. This prevents the parasitic capacitance from adversely affecting the wideband resistive matching network that might otherwise narrow its VSWR bandwidth considerably. The input in FIGS. 4 and 5 is the transmitter/receiver TR1 designated as source SO1. In FIG. 5 capacitor CI1 tunes the impedance matching network IM2 with the inductance Lp to the frequency of the radiator CR1.

Figure 6:
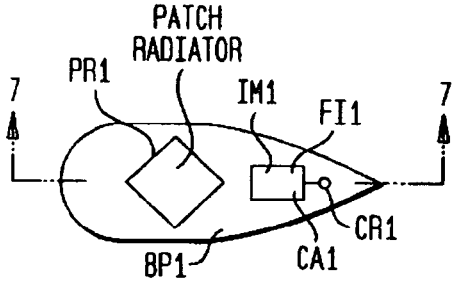
FIG. 6 is a plan view of another embodiment of the antenna in FIGS. 1 and 2.
Figure 7:
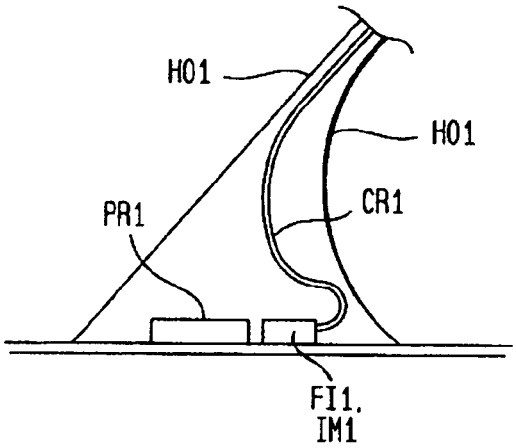
FIG. 7 is a section 7—7 of the embodiment of the antenna in FIG. 6.
Figure 8:
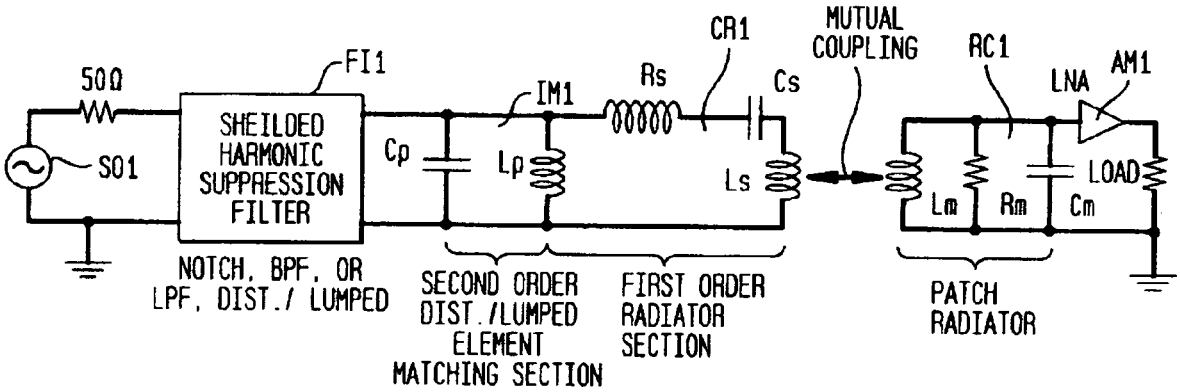
FIG. 8 is a schematic equivalent circuit of an embodiment of the antenna of FIGS. 6 and 7.

In another embodiment, the antenna AN1 lessens the drag of the number of aircraft antennas by incorporating two antenna radiators into the single housing HO1. FIGS. 6, 7, and 8 illustrate the antenna system AS1 of such a device. FIG. 6 is a plan view of the antenna system AS1 and FIG. 7 a section 7—7 of FIG. 6. Here, the base plate BP1 supports a patch radiator PR1 adjacent a structure containing the capacitor Cp that forms the impedance matching network IM1 with the inductance Lp, and the harmonic suppression filter FI1. The cable radiator CR1 extends upwardly from the filter FI1. The housing HO1 covers the base plate BP1, and encloses the patch radiator PR1, the filter FI1, the impedance matching network MI1, and the cable radiator CR1. The shielding can CA1 of FIG. 3 encapsulates the filter FI1.

FIG. 8 shows an equivalent circuit of one embodiment of the antenna system AS 1 illustrated in FIGS. 6 and 7 and includes the monopole antenna radiator element or cable radiator CR1 having the RLC circuit with inductance Ls, capacitor Cs, and resistor Rs. It further includes the resonant impedance matching network IM1 having capacitor Cp parallel to the "internal" inductance Lp of the radiator RC1; and the harmonic suppression filter FI1 in the form of a shielded multiple-section notch, low pass, or band pass filter built with either distributed or lumped element components.

Here again the impedance matching circuit IM1, containing capacitor Cp and inductor Lp, is tuned to the same frequency as the cable radiator CR1 represented by the inductance Ls and capacitance Cs, in one embodiment 127.5 MHz. This produces the double-dip VSWR appearing in FIG. 4A across a band from 118 MHz to 137 MHz.

The right hand part of the circuit in FIG. 8 includes the equivalent circuit of the second antenna radiator element, i.e., the patch radiator PR1. The latter is represented by equivalent parallel RLC circuit RC1 with inductance Lm and capacitance Cm and Rm, and amplifier AM1 (with or without band pass filtering for the application). A bias feed mechanism (not shown) provides DC current to the amplifier AM1. The RLC equivalent circuit RC1 characterizes any of the GPS (1,575.42 MHz), WSI (1544.5 MHz), XM Satellite and/or Sirius Satellite (2,332.0–2,345 MHz), Globalstar (2483.5–2500 MHz and 1610.0–1626.5 MHz), Iriduim (1616–1626.5 MHz), Satcom (1530–1559 and 1626.5–1660.5 MHz), etc. antenna configurations. FIG. 8 illustrates the mutual coupling between radiators PR1 and CR1. The mutual coupling between of any harmonic RFI (Radio Frequency Interference) from the radiator CR1 and the second antenna element patch radiator PR1 is attenuated by the shielded harmonic suppression filter FI1 in the VHF monopole impedance matching network.

Depending upon the values of the capacitor Cp and the structure of radiators CR1 and PR1, this arrangement enables the antenna AN1 to function over narrow to medium frequency bandwidths for either transmit or receive applications over various frequency bands in the VHF and UHF frequency spectrum (VHF Comm. 180–150 MHz, Orbcomm 137–150 MHz, etc.). At the same time, any harmonic electromagnetic interference that may be generated by the antenna transmitter TR1 that could adversely affect any of the GPS (1,575.42 MHz), WSI (1544.5 MHz), XM Satellite and/or Sirius Satellite (2,332.0–2,345 MHz), Globalstar (2483.5–2500 MHz and 1610.0–1626.5 MHz), Iriduim (1616–1626.5 MHz), Satcom (1530–1559 and 1626.5–1660.5 MHz), etc. adjacent antennas are suppressed to non-interfering levels.

The radiator PR1 need not be a patch radiator but may be another kind. According to the embodiment in FIG. 6, the patch radiator PR1 is rotated to a diamond position relative to the filter FI1. This position tends further to limit the radio frequency interference from the cable radiator CR1. However, in other embodiments, the patch radiator PR1 may be rotated to other positions, such as 90 degrees.

Figure 9:
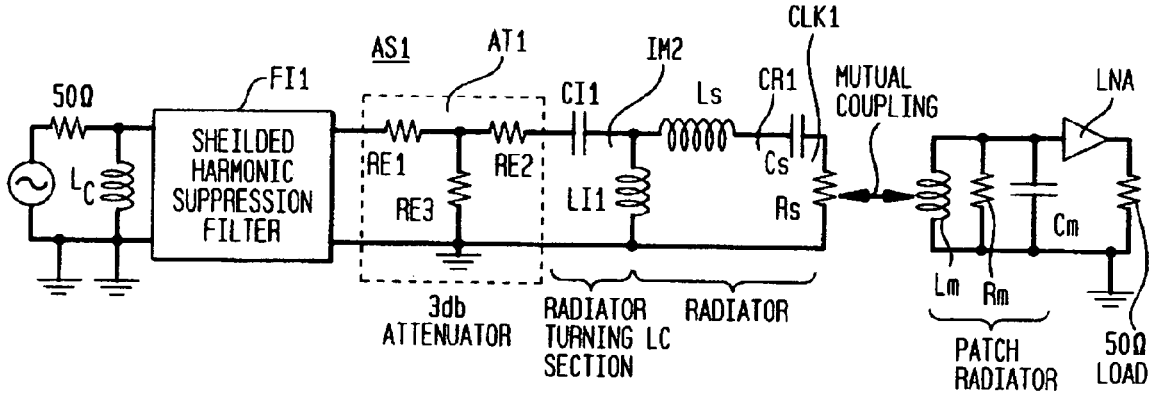
FIG. 9 is a schematic equivalent circuit of another embodiment of the antenna of FIGS. 6 and 7.

FIG. 9 illustrates an equivalent circuit of another embodiment of the antenna system AS1 illustrated in FIGS. 6 and 7 and includes the monopole antenna radiator element or cable radiator CR1 having the RLC circuit with inductance Ls, capacitor Cs, and resistor Rs. It further includes a basic wide band resistive impedance matching network IM2 with a capacitance CI1 and an inductance LI1 and a 3 db attenuator with resistors R1, R2, R3 in T-configuration, and a shielded multiple section notch, low pass or band pass filter F1, built with either distributed or lumped element components. This enables the antenna to tune over wide frequency bandwidths for either transmit or receive applications over frequency bands in the VHF/UHF frequency spectrum (Wideband VHF/Orbcomm 118–150 MHz, etc.). A compensating inductor Lc (in the form of a lumped element such as 120 nH in one embodiment) or (in the form of a distributed inductor in another embodiment) across the input and parallel to the filter FI1 input serves to cancel a (10 pF for example) parasitic capacitive reactance of the filter FI1 that may occur at VHF frequencies. This avoids adversely affecting the wideband resistive matching network that would narrow its VSWR bandwidth considerably. This inductor Lc broadens out the VSWR across the desired wideband VHF frequency band.

Figure 10:
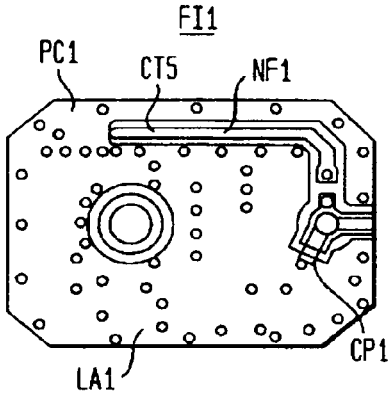
FIG. 10 is a bottom view of an embodiment of a printed circuit board with a filter suitable for the antennas in FIGS. 1 to 9.
Figure 11:
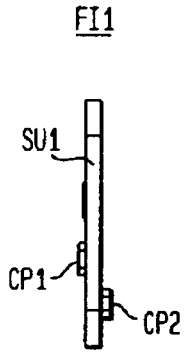
FIG. 11 is a side view of the board in FIG. 10.
Figure 12:
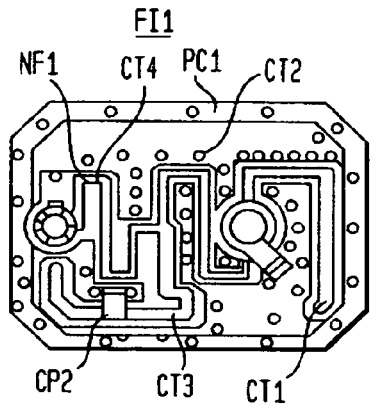
FIG. 12 is a top view of the board in FIG. 10.
Figure 13:
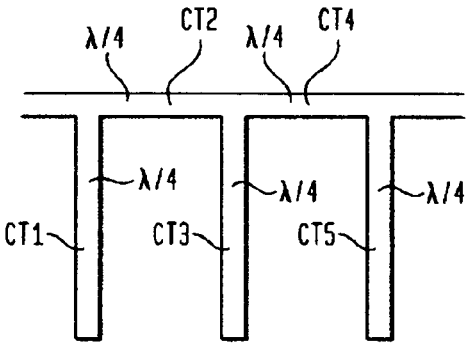
FIG. 13 is a schematic representation of the filter in FIGS. 10, 11, and 12.
Figure 14:
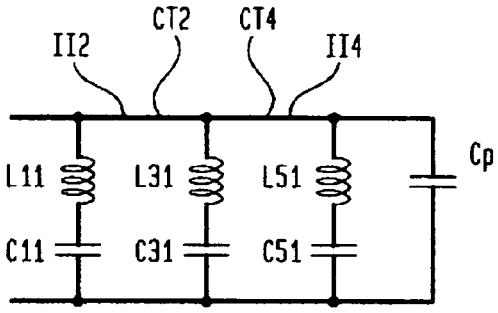
FIG. 14 is a schematic diagram of an equivalent circuit of the filter in FIGS. 10, 11, and 12.

FIGS. 10, 11, and 12 are bottom, side, and top views illustrating details of an embodiment of an harmonic suppression filter FI1 in the form of a notch filter NF1 on a printed circuit board PC1. FIG. 13 is schematic view and FIG. 14 an equivalent circuit of the notch filter of FIGS. 11, 12, and 13. In these figures, a substrate SU1 supports the filter. Connected conductive traces CT1, CT3, and CT5 oppose ground planes to form distributed quarter wave (λ/4) LC circuits L11 and C11, L31 and C31, L51 and C51. The interconnecting conductive traces CT2 and CT4 form distributed quarter wave LC impedance inverters II2 and II4. Conductive lands LA1 spaced from, and surrounding the conductive traces CT1, CT2, CT3, CT4, and CT5 on the top and bottom of the printed circuit board PC1 provide the ground planes for the conductive traces. Conductive via holes VH1 connect the lands L1 on the top with the lands L1 on the bottom of the printed circuit board PC1. A chip capacitor CP1 (for example 47 pF) is used as part of the resonant impedance matching network IM1 and corresponds to capacitor Cp in FIGS. 4, 8, and 14. The notch filter NF1 constitutes a third order microstrip notch filter. It has a characteristic low impedance shunt path to ground for resonant in-band (GPS, WSI, XM Satellite and/or Sirius Satellite, Globalstar, Iriduim, Satcom, etc.) harmonic energy. For VHF frequencies the filter FI1 provides a high impedance path to ground and serves as a low insertion loss transmission line which couples base band energy directly to the antenna impedance matching network and radiator The conductive can CA1 of FIGS. 3 and 6 surrounding the PC board PC1 shields the filter FI1 to prevent leakage from the microstrip.

A capacitor CP2 (for example 0.5 pf) extends from the central portion of conductive trace CT3 to ground. The purpose of this capacitor is to adjust the effective length of the conductive trace CT3. Conductive traces on printed circuit boards often have insufficient space to follow straight paths and accordingly follow winding paths. However, the board may not provide enough room even for such folded paths. The capacitor CP2 adjust for this deficiency in FIGS. 10, 11, and 12. The Capacitor is necessary only when the length of the trace is inadequate.

Figure 15:
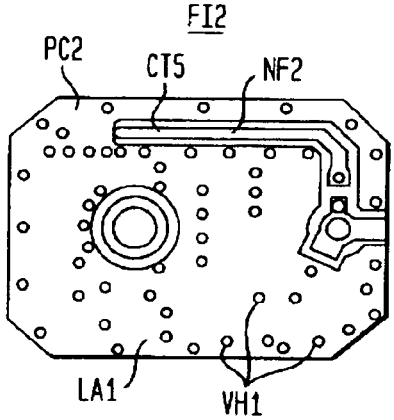
FIG. 15 is a bottom view of an embodiment of a printed circuit board with a filter suitable for the antennas in FIGS. 1 to 9.
Figure 16:
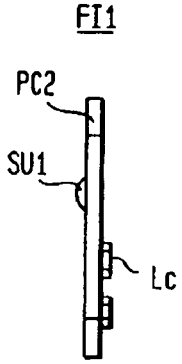
FIG. 16 is a side view of the board in FIG. 15.
Figure 17:
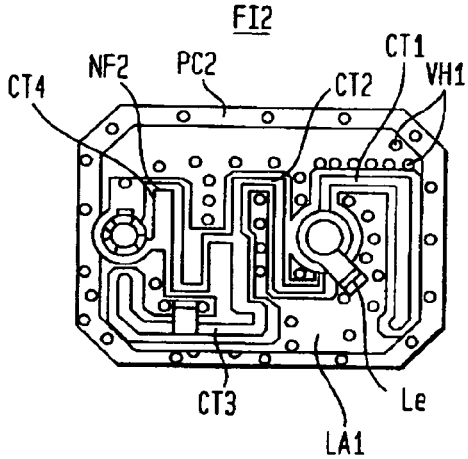
FIG. 17 is a top view of the board in FIG. 15.
Figure 18:
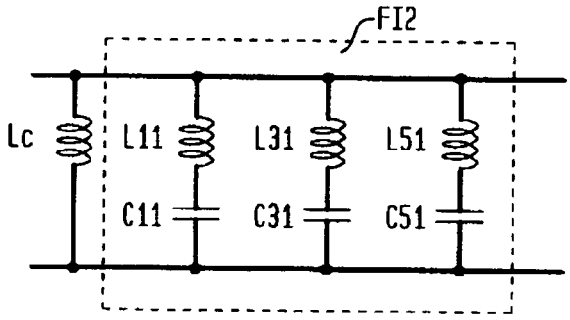
FIG. 18 is a schematic diagram of an equivalent circuit of the filter in FIGS. 15, 16, and 17.

FIGS. 15, 16, and 17 are bottom, side, and top views illustrating details of an embodiment of an harmonic suppression filter F12 in the form of a notch filter NF2 for use with the impedance matching network IM1 on a printed circuit board PC1. FIG. 18 is an equivalent circuit of the notch filter of FIGS. 15, 16, and 17. FIG. 13 is schematic view of FIGS. 15, 16, and 17. In these latter figures, a substrate SU1 also supports the filter F12 and the can CA1 shields the filter. Connected conductive traces CT1, CT3, and CT5 also oppose ground planes to form distributed quarter wave (λ/4) LC circuits L11 and C11, L31 and C31, L51 and C51. The interconnecting conductive traces CT2 and CT4 form distributed quarter wave LC impedance inverters II2 and II4. Conductive lands LA1 spaced from, and surrounding the conductive traces CT1, CT2, CT3, CT4, and CT5 on the top and bottom of the printed circuit board PC1 provide the ground planes for the conductive traces. Conductive via holes VH1 connect the lands L1 on the top with the lands L1 on the bottom of the printed circuit board PC1. The chip inductor Lc of FIG. 9 at the input serves to retune the broadband matching network. Its placement, in parallel to ground with the stray parasitic parallel capacitance to ground of the notch filter, brings them both to parallel resonance and high impedance at VHF frequencies. This effectively cancels detrimental capacitive loading effects of the filter FI2 and allows the resistive matching network to function properly.

The printed circuit board PC1 in FIGS. 15, 16, and 17 also uses a capacitor CP2 from the central portion of the trace CT3 to ground in order to adjust the effective length of the trace.

Figure 19:
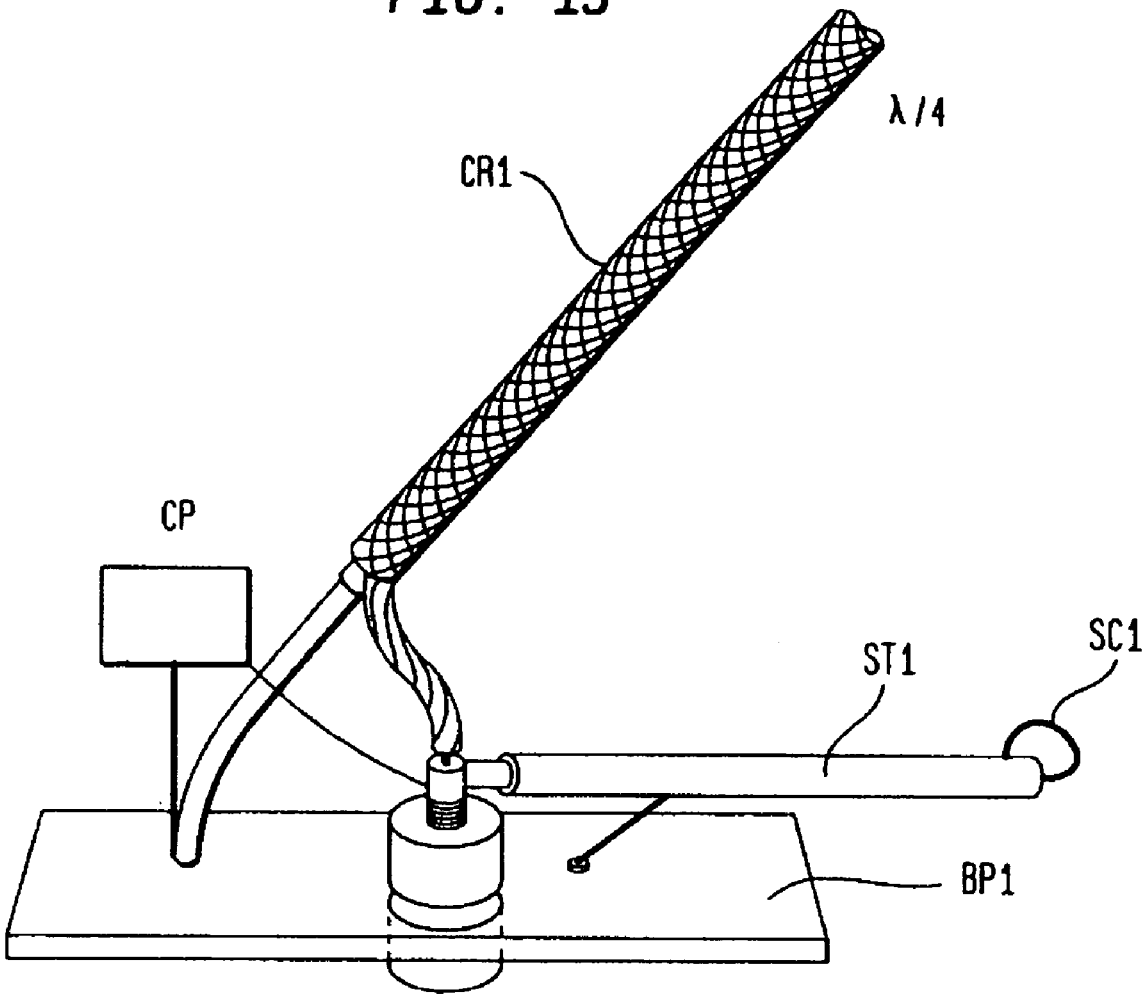
FIG. 19 is a diagram illustrating another embodiment of the invention.

FIG. 19 illustrates another embodiment of the arrangement in FIGS. 3 and 3A as applied to FIGS. 4 and 8. Here, a shorted quarter wave stub ST1 appears across the capacitor Cp of FIGS. 3, 3A, 4, and 8. The quarter wave is for the center frequency of the VHF band at which the cable radiator operates. A short circuit ST1 for the stub ST1 is shown at the end opposite the connection to the capacitor Cp. The shorted quarter wave stub ST1 has the effect of forming a DC ground for the shield or outer conductor OC1 of the cable radiator CR1. The shorted quarter wave stub ST1 also has the effect applying a high radio-frequency impedance at the center and across the VHF band at which the cable radiator CR1 operates. The stub ST1 is, according to an embodiment of the invention, coiled around the can CA1 in FIG. 3. The DC grounding function of the stub ST1 is not needed in FIGS. 5 and 9 because the inductor LI1 serves that purpose.

Figure 4A:
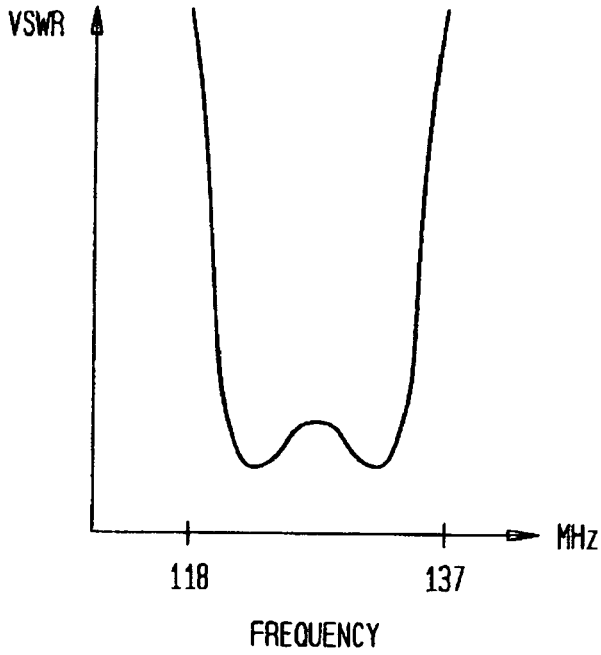
FIG. 4A is a graph illustrating an embodiment of an operation of the antenna of FIGS. 1, 2, 3, 3A, and 4.

The embodiments of the invention permit close placement of aircraft antennas and combination antennas involving enclosure of multiple antenna radiators in a single aerodynamic housing. While the tuning of VHF/UHF radiators and matching circuits produce bandpasses as shown in FIG. 4A, the embodiments of the invention suppress harmonic, such as 12th and 13th harmonics, substantially outside the range of the desired VHF/UHF bandpass from affecting nearby higher frequency radiators.

According to another embodiment of the invention, the frequencies defined by the inductance and capacitance values of the impedance matching networks IM1 and IM2 do not equal frequencies defined by the inductance Ls and capacitance Cs, but are only sufficiently close to widen the bandbass of the radiator CR1.

While embodiments of the invention have been described in detail, it will be evident to those skilled in the art that the invention may be embodied otherwise.

What is claimed is:

1. An aircraft antenna, comprising:

an aerodynamic housing structured for attachment to an outer surface of an aircraft;

a system in the housing, said system having an electromagnetic radiator and being tuned over a first band of frequencies potentially to produce secondary radiations in at least a second band of frequencies;

said system having a suppression filter effective at a frequency of the secondary radiations;

said system having a second order matching section for said radiator and including a capacitor and a parallel inductance;

said suppression filter being a shielded harmonic suppression filter and including one of a low pass filter and a band pass filter.

2. An aircraft antenna as in claim 1, wherein said secondary radiations include harmonics of frequencies in the first band and the suppression filter is a harmonic suppression filter of said harmonics.

3. An aircraft antenna as in claim 1, wherein said suppression filter is a low pass filter.

4. An aircraft antenna as in claim 2, wherein said second band of frequencies includes the frequencies of one of GPS e.g. 1575.42 MHz, WSI e.g. 1544.5 MHz, XM Satellite and/or Sirius Satellite e.g. 2332.0–2345 MHz, Globalstar e.g. 2483.5–2500 MHz and 1610.0–1626.5 MHz, Iriduim e.g. 1616–1626.5 MHz, Satcom e.g. 1530–1,559 and 1626.5–1,660.5 MHz.

5. An aircraft antenna as in claim 4, wherein the system includes a capacitance compensating inductor at the input of the harmonic suppression filter.

6. An aircraft antenna as in claim 2, wherein the suppression filter is a band pass filter.

7. An aircraft antenna as in claim 1, wherein said system includes a second electromagnetic radiator in the housing and tuned over the second band of frequencies.

8. An aircraft antenna as in claim 7, wherein said second radiator is a patch radiator and said first radiator is a cable radiator, and said secondary radiations are harmonics of frequencies in the first band.

9. An aircraft antenna as in claim 7, wherein said second radiator is a patch radiator and said first radiator is a cable radiator, and said patch radiator operates at a band of frequencies that includes the frequencies of one of GPS e.g. 1575.42 MHz, WSI e.g. 1544.5 MHz, XM Satellite and/or Sirius Satellite e.g. 2332.0–2345 MHz, Globalstar e.g. 2483.5–2500 MHz and 1610.0–1626.5 MHz, Iriduim e.g. 1616–1626.5 MHz, Satcom e.g. 1530–1,559 and 1626.5–1,660.5 MHz.

10. An aircraft antenna as in claim 7, wherein said housing has an elongated shape to project from the surface of an aircraft and surrounding the cable radiator and a has an inverted clip cover surrounding the patch radiator and the filter at the base of the elongated shape.

11. An aircraft antenna as in claim 7, wherein said second radiator is a patch radiator and said first radiator is a cable radiator, and said secondary radiations are harmonics of frequencies in the first band; and said patch radiator has a rectangular shape and the filter is placed at the tip of the rectangular shape of the patch radiator.

12. An aircraft antenna as in claim 1, wherein said system includes a matching network and said matching network has a shorted quarter wave stub connected across the electromagnetic radiator so as to form a DC short circuit across the electromagnetic radiator, the quarter wave being defined as the center of the band of said electromagnetic radiator.

13. An aircraft antenna comprising:

an aerodynamic housing structured for attachment to an outer surface of an aircraft;

a first system in the housing, said first system having an electromagnetic radiator and being tuned over a first band of frequencies potentially to produce secondary radiations in at least a second band of frequencies;

said first system having a suppression filter effective at the frequencies of the secondary radiations;

wherein a matching network includes a shorted quarter wave stub connected across the electromagnetic radiator so as to form a DC short circuit across the electromagnetic radiator, the quarter wave being defined as the center of the band of said electromagnetic radiator.

14. An aircraft antenna, comprising:

an aerodynamic housing structured for attachment to an outer surface of an aircraft;

a system in the housing, said system having an electromagnetic radiator and being tuned over a first band of frequencies potentially to produce secondary radiations in at least a second band of frequencies;

said system having a suppression filter effective at the frequencies of the secondary radiations;

said system having a second order matching section for said radiator and including a capacitor and a parallel inductance;

said suppression filter being a shielded harmonic suppression filter;

said suppression filter including a plurality of filter sections.

15. An aircraft antenna as in claim 14, wherein said stem includes a matching network and said matching network has a shorted quarter wave stub connected across the electromagnetic radiator so as to form a DC short circuit across the electromagnetic radiator, the quarter wave being defined as the center of the band of said electromagnetic radiator.

16. An aircraft antenna as in claim 14, wherein said filter sections exhibits a characteristic center frequency within the second band of frequencies, said filter sections having a first filter section and a second filter section, the first of said filter sections having an operating center frequency close to the characteristic center frequency of said filter sections, whereby simultaneous operation of the first filter section and the second filter section form the first band of frequencies having a wider band than said first filter section and said second filter section.

17. An aircraft antenna as in claim 14, wherein said suppression filter includes a circuit board with a plurality of connected conductive traces each forming distributed quarter wave LC circuits and an interconnecting conductive traces forming distributed quarter wave LC impedance inverters.

18. An aircraft antenna as in claim 17, said suppression filter includes a circuit board with a three connected conductive traces forming three distributed quarter wave LC circuits and two interconnecting conductive traces forming two distributed quarter wave LC impedance inverters, so as to form a three pole arrangement.

19. An aircraft antenna as in claim 14, wherein said harmonic suppression filter is a microstrip notch filter having a plurality of sections each with lengths of one-quarter wavelength of the frequencies to be suppressed.

20. An aircraft antenna as in claim 14, wherein said harmonic suppression filter is a third order microstrip notch filter having sections with lengths one-quarter wavelengths of the frequencies to be suppressed.

* * * * *